US005862632A

United States Patent [19]

Zima

[11] Patent Number: 5,862,632

[45] Date of Patent: Jan. 26, 1999

[54] DISCHARGE FOR DOWNSPOUTS

[76] Inventor: Eric M. Zima, 1113 New Brunswick Ave., Manasquan, N.J. 08736

[21] Appl. No.: 804,625

[22] Filed: Feb. 25, 1997

[51] Int. Cl.[6] ..... E04D 13/08

[52] U.S. Cl. ..... 52/16

[58] Field of Search ..... 52/11, 16; 137/357

[56] References Cited

U.S. PATENT DOCUMENTS

| | | | |
|---|---|---|---|
| 4,620,817 | 11/1986 | Cushing | 52/16 |
| 4,798,028 | 1/1989 | Pinion | 52/16 |
| 5,114,594 | 5/1992 | Rosebrock et al. | 52/12 |
| 5,435,051 | 7/1995 | Cheremshynski | 52/16 |
| 5,452,743 | 9/1995 | Rortvedt | 52/16 |
| 5,533,303 | 7/1996 | Harvey | 52/16 |
| 5,658,092 | 8/1997 | Sweers | 52/16 |
| 5,673,519 | 10/1997 | McCaughan | 52/16 |

*Primary Examiner*—Michael Safavi
*Attorney, Agent, or Firm*—Clifford G. Frayne

[57] ABSTRACT

A discharge adaptor for downspouts to disburse rain water at a preselected distance away from the foundation of a building. The discharge adaptor having a mating unit, having a generally elbow shape having a vertical and horizontal portion. The vertical portion secured to the lower end of the downspout and the horizontal portion designed to terminate in a nozzle for the discharge of the rain water. The inner circumference of the horizontal portion of the mating unit having a decreasing circumference from the vertical portion of the mating unit to the nozzle portion.

4 Claims, 2 Drawing Sheets

DISCHARGE FOR DOWNSPOUTS

BACKGROUND OF THE INVENTION

1. Field of Invention

This invention relates to downspouts and an adaptor for attachment to downspouts which will direct the run off of rain water and/or melting snow away from the foundation to prevent flooding of basements and simultaneously provide additional water for plants, shrubbery and the lawn about the building.

2. Description of the Prior Art

Typical gutters and their related downspouts direct the rain water accumulated on the roof of a building downwardly toward the foundation and discharge the water into the ground immediately adjacent the foundation. Depending on the building and quality of construction, often times this discharge of rain water by means of the downspout immediately adjacent the foundation will cause minor or major flooding within the basement.

In addition, the immediate discharge of rain water from a typical downspout directs the discharge of the water at one particular location which often times will cause the erosion at that particular location.

It is therefore an object of the present invention to provide a discharge system which will reduce the possible inflow of rain water into the basement, and simultaneously prevent erosion by permitting the rain water to be directed over a wider area. Complimentary with the foregoing objectives is the design of the adapter and the weight of the adaptor which will allow the homeowner to reposition the adaptor and discharge so that the down flow of rain water can be directed and its release regulated to specific shrubbery or areas of the lawn requiring additional watering.

Various attempts have been made to provide for such a discharge, but in most instances, these attempts merely direct the down flow of rain water further away from the foundation, but do not solve the erosion problem, nor the ability to be moved easily to provide for a preference of water flow. One of the simplest solutions would be to extend the downspout by means of a similar piece of corrugated tubing to a distance 10 to 15 feet from the foundation. While this directs the water way from the foundation, it does not solve the erosion problem and presents an aesthetically unpleasing view of the yard or lawn. Another attempt has been to utilize a polyethylene tube tied about the downspout, the polyethylene tube having an opening at its end and possibly smaller openings disposed between its end and the downspout to direct the water away from the foundation during periods of rain and to cause some rain water to be disbursed through the openings intermediate in the tube. While these can be rolled up when not in use, they have proven to be very inefficient and cumbersome in maintaining their secured contact with the downspout.

Cushing in U.S. Pat. No. 4,620,817 discloses an underground discharge for downspouts and sump pumps. While this system would appear to be effective, it is also an expensive system to install, since it requires the excavating of the lawn for its installation and does not provide the flexibility of applicant's adaptor system which allows for the homeowner to rearrange or move the downspout adaptor to a predetermined location.

OBJECTS OF THE INVENTION

An object of the present invention is to provide for a novel downspout adaptor attachable to normal downspouts, which will direct rain water away from the foundation of the building.

A still further object of the present invention is to provide for a novel downspout adaptor attachable to a normal downspout, which will disburse the rain water over a wider area and prevent erosion of the lawn or shrubbery.

A still further object of the present invention is to provide for a novel discharge adaptor which is telescopic in nature and which will allow the homeowner to choose the distance from the foundation at which the water will be discharged.

A still further object of the present invention is to provide for a novel discharge adaptor for normal downspout which is flexible in nature and which will allow the homeowner to position the adaptor adjacent to a particular area or shrubbery which requires additional water.

A still further object of the present invention is to provide for a novel discharge adaptor having variable nozzles at its terminus which disburses the rain water in a preference of sprays.

A still further object of the present invention is to provide for a novel discharge adaptor for a normal downspout, which is easily installed, moveable and removable in that all of its elements are positioned above ground and easily camouflaged by its color and surrounding foliage.

SUMMARY OF INVENTION

A discharge adaptor for a normal downspout to disburse rain water at a preselected distance away from the foundation of the building and to disburse the rain water in a gentle spray, the adaptor having an adaptor member fixable to the downspout, and flexible or telescopic tubing extending therefrom for a preselected distance, the telescopic or flexible tubing having a spray nozzle affixed at its opposite terminus for discharge of the rain water in a gentle spray, and the entire adaptor unit being positioned above ground and easily positionable in a desired location away from the foundation of the building.

BRIEF DESCRIPTION OF THE DRAWINGS

These and other objects of the present invention will become evident, particularly taken in light of the following drawings wherein.

DETAILED DESCRIPTION OF THE DRAWINGS

Figure 1:
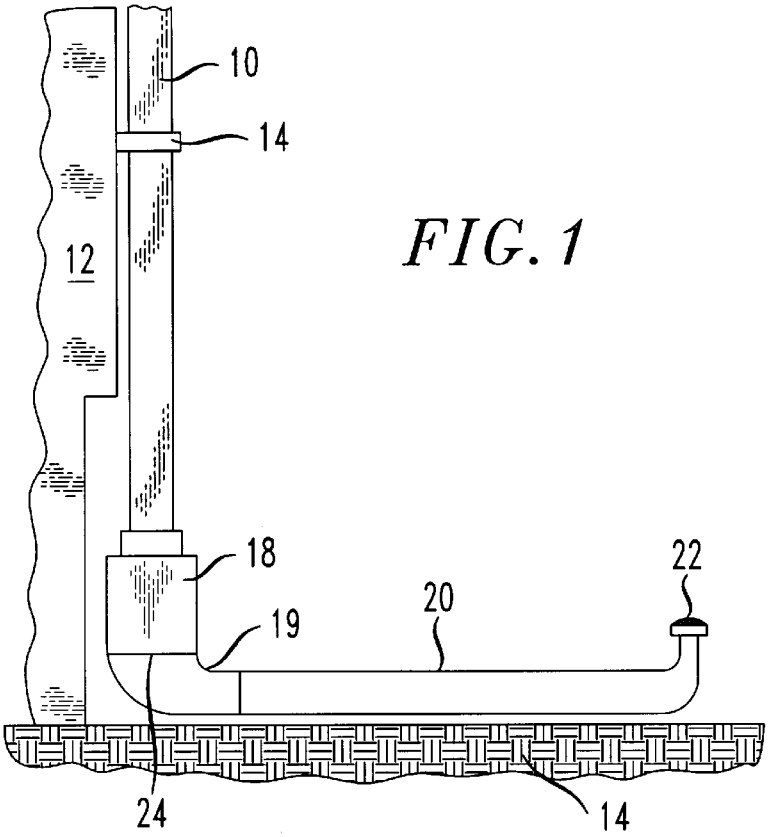
FIG. 1 is a side view of the adaptor member affixable to the downspout.

FIG. 1 is a side view of a typical downspout configuration affixed to the side of a dwelling which has been adapted to applicant's downspout distributor. FIG. 1 illustrates a first embodiment of applicant's downspout distributor. Typically, the downspout 10 would depend vertically downwardly from the gutters position horizontally along the edge of the roof (not shown). The downspout 10 would be affixed to the outer sheathing 12 of the dwelling by means of a plurality of hooks 14 secured to the outer sheathing of the dwelling and which envelop all or a portion of the downspout 10 at various points. Typically, the downspout 10 would terminate proximate the ground 14 with an elbow (not shown) which would direct the flow of water perpendicularly from the foundation 16 of the dwelling unit. The elbow is easily removable from downspout 10 and applicant's adaptor can be installed.

In its simplest form, the adaptor comprises an adaptor mating unit 18 which is securable to the terminous of downspout 10. A portion of downspout 10 projects inwardly into the adaptor mating unit 18. The adaptor mating unit 18 has an elbow 19 and is secured to a longitudinal tube 20 of decreasing diameter which extends outwardly and away from foundation 16 and terminates in a sprinkler head 22. Longitudinal tube 20 would be removably securable from adaptor mating unit 18, such that the owner or user could select a predetermined length of tubular member 20 in order to extend or direct the downflow of water the desired distance from the foundation 16. Additionally, tubular member 20 may be secured to adaptor mating unit 18 in a rotatable fashion in such that it could swivel a desired degree of angularity in a horizontal plane as a result of the tubular member 20 and adaptor mating member 18 being swivelly mounted at 24. This mounting means enables the user to disconnect the tubular member from the adaptor mating unit in order to flush out any leaves or accumulated debris which may deposit therein.

Figure 2:
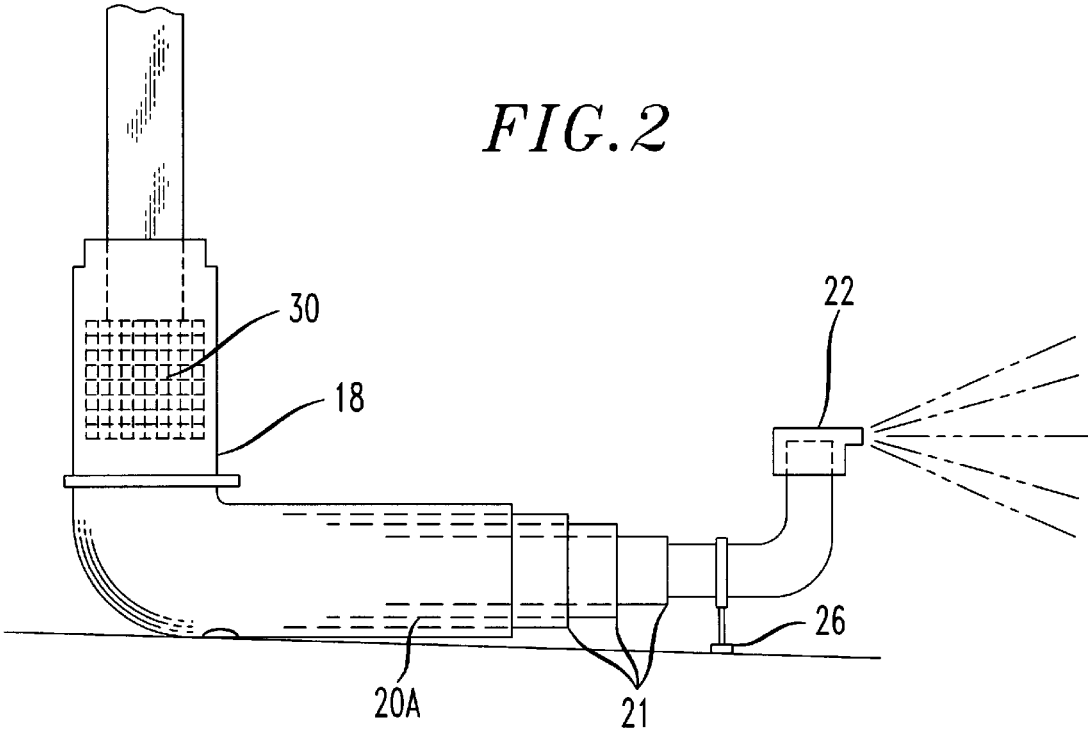
FIG. 2 is a side view of a discharge adaptor having a telescopic tubing arrangement of reduced diameter secured to the downspout.

FIG. 2 illustrates a side elevational view of a second embodiment of the downspout distributor similar to the first embodiment illustrated in FIG. 1 with the exception that the tubular member 20A illustrated in FIG. 2 has a decreasing diameter from the adaptor mating unit 18, but the decreasing diameter is accomplished by means of a telescoping tubular member 20A having a plurality of sections 21 slidably positioned within each other to allow the user to selectively adjust the distance at which nozzle 22 will be positioned from the foundation 16. Due to the telescoping nature of the embodiment illustrated in FIG. 2, nozzle 22 may require a support member 26 to maintain its stability under the head of water passing through downspout 10 and through telescope tubular member 20A. In either embodiment illustrated in FIG. 1 or 2, spray nozzle 22 is removably secured to tubular member 20 or 20A in order that it may cleaned when desired.

Figure 3:
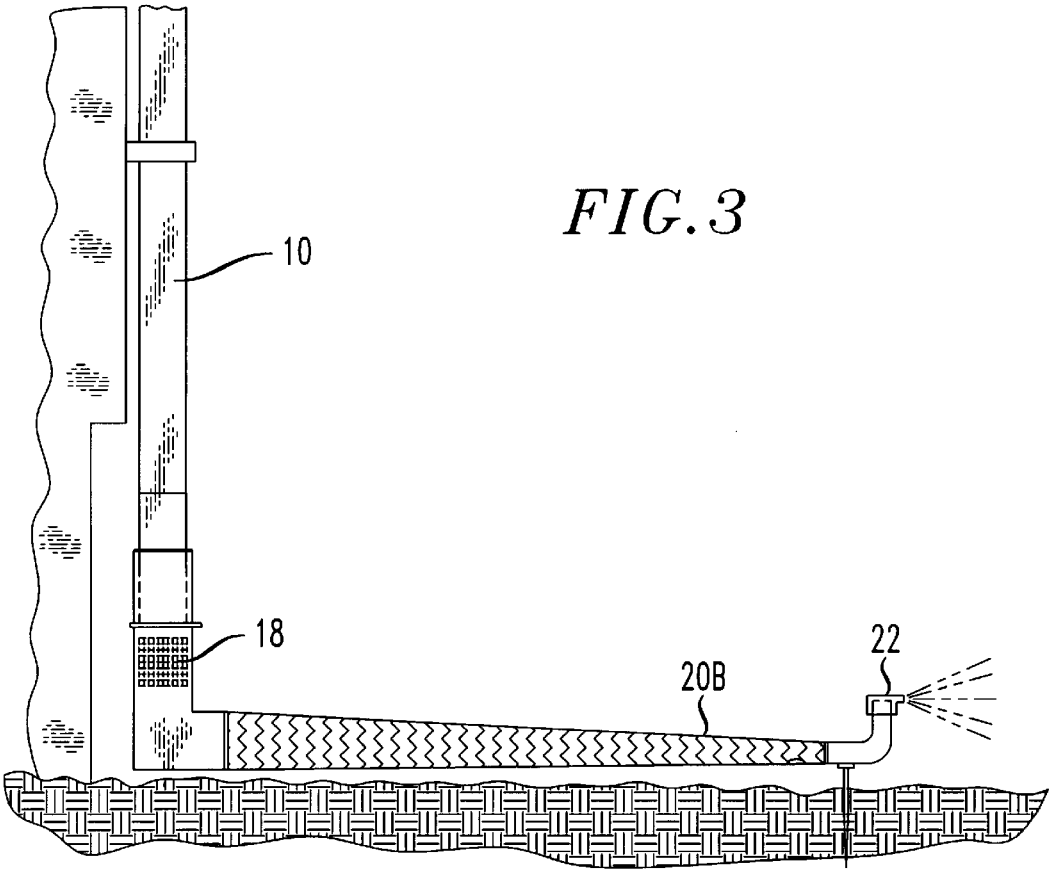
FIG. 3 is a side view of a flexible discharge adaptor secured to a downspout.

FIG. 3 is a side elevational view of a third embodiment of the downspout distributor in accordance with the present invention wherein the tubular member 20 is not rigid, but rather, is flexible and identified as 20B in FIG. 3. In this view, the adaptor mating unit is again affixed to the downspout 10, however, the flexible tubing 20B can be positioned in any desired location by the user. This embodiment is particularly useful when the homeowner wishes to utilize the accumulated water to further wet or drench a particular location such as shrubbery. The user can utilize the flexible tubing 20B to form a path to a particular bush, shrub or area of ground acquiring additional watering. Again, flexible tubing 20B as illustrated in FIG. 3 would have a decreasing diameter and terminate in a spray nozzle 22 which would evenly distribute the rainwater from the downspout over a wider area than if it were allowed to exit the downspout directly, approximate to the foundation.

Figure 4:
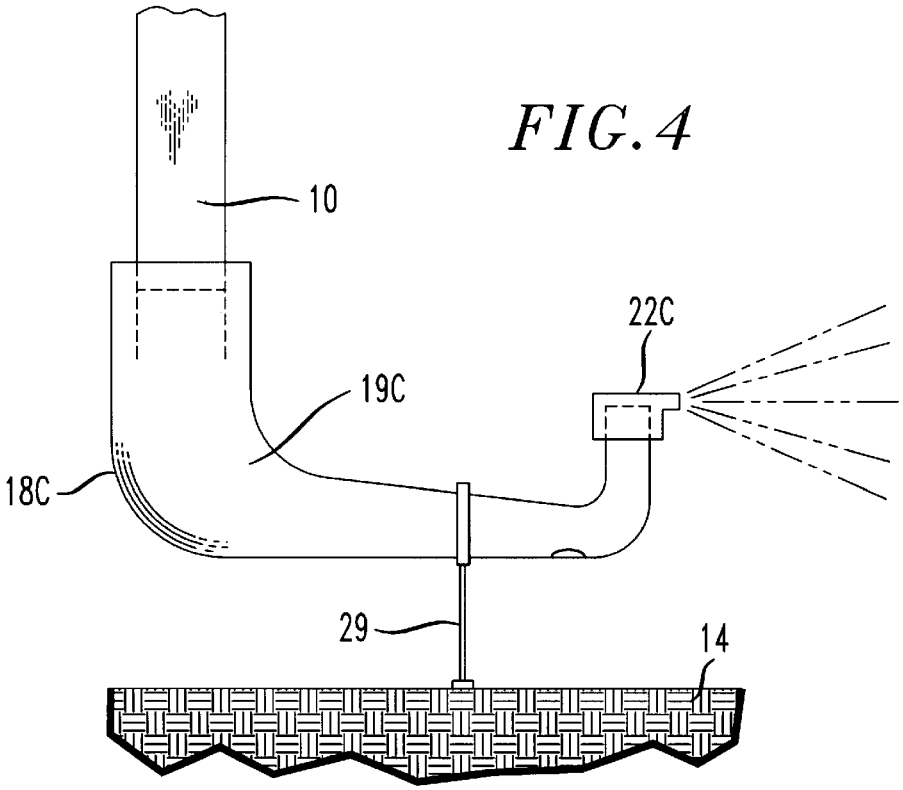
FIG. 4 is a side view of another embodiment of a discharge adaptor which utilizes the fluid head of the rain water to direct the rain water in a gentle spray away from the foundation.

FIG. 4 is a side elevational view of still another embodiment of the present invention. In this embodiment, the adaptor mating unit 18C is of one piece construction comprising an elbow unit 19C which slips over the lower terminus of downspout 10. The longitudinal portion of the adaptor mating unit 18C is considerably shorter in this embodiment and terminates in a sprinkler head or nozzle 22C which is designed to direct the flow of water in a spray-like fashion away from the foundation. The longitudinal portion of mating unit 18C is of decreasing diameter and in this configuration, a support member 29 would maintain the mating unit 18C and position vis-a-vis the lower terminus of downspout 10. In this embodiment, the owner could easily remove the mating unit 18C for cleaning and the removal of leaves or other debris and quickly reposition the mating unit 18C.

An additional feature of the adaptor mating units illustrated in FIGS. 1, 2, and 3 could be the inclusion of a debris strainer within the vertical portion of mating unit 18 in order to prevent leaves and debris from reaching the longitudinal portion of the adaptor and clogging the adaptor. The filter or strainer 30 could comprise a wire mesh positioned within the vertical portion of the adaptor mating unit, and across the flow of water as illustrated in FIG. 5 which is a partial cut away view of the adaptor mating unit 18. It will be recognized that various forms of filter media could be utilized or the filter media could be absent and the homeowner would merely remove the adaptor mating unit and flush it with a hose periodically to remove any accumulated debris.

While the invention has been described in connection with an exemplary embodiment thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

I claim:

1. An above ground discharge distribution apparatus for distributing discharge rain water from a building, said apparatus comprising:

a downspout vertically disposed on said building having an upper end in communication with the horizontal gutters associated with the roof of said building and a lower discharge end;

a mating unit secured to said lower end of said downspout said mating unit of tubular construction having an elbow configuration having a vertical portion and a horizontal portion, said vertical portion of said elbow secured to said lower end of said downspout, said horizontal portion of said elbow of said mating unit directed away from said building;

a nozzle member secured to the terminus of said horizontal portion of said mating member, said nozzle member having a plurality of perforations for distribution of said discharge rain water in a spray manner away from said building, said horizontal portion of said elbow of said mating unit having a decreasing interior circumference between said vertical portion of said mating member and said nozzle member.

2. The discharge apparatus in accordance with claim 1 wherein said horizontal portion of said mating member is further comprised of a plurality of telescopic members positioned between said vertical portion of said mating member and said nozzle member for extension of said nozzle member away from said building.

3. The discharge apparatus in accordance with claim 1 wherein said horizontal portion of said mating member is further comprised of a flexible tubular member between said mating unit and said nozzle member for extension of said nozzle member away from said building.

4. The discharge apparatus in accordance with claim 1 wherein said vertical portion of said mating member has positioned therein, a filter member for the collection of leaves and debris.

* * * * *